US006761750B2

(12) United States Patent
Zackrisson et al.

(10) Patent No.: US 6,761,750 B2
(45) Date of Patent: Jul. 13, 2004

(54) CEMENTED CARBIDE WITH BINDER PHASE ENRICHED SURFACE ZONE

(75) Inventors: Jenni Zackrisson, Fagersta (SE); Jan Qvick, Virsbo (SE)

(73) Assignee: SECO Tools AB, Fagersta (SE)

( * ) Notice: Subject to any disclaimer, the term of this patent is extended or adjusted under 35 U.S.C. 154(b) by 0 days.

(21) Appl. No.: 10/303,845

(22) Filed: Nov. 26, 2002

(65) Prior Publication Data

US 2003/0115984 A1 Jun. 26, 2003

(51) Int. Cl.[7] ..... C22C 29/08

(52) U.S. Cl. ..... 75/241; 75/239; 75/240; 75/242; 428/545

(58) Field of Search ..... 75/239, 240, 241, 75/242; 428/545

(56) References Cited

U.S. PATENT DOCUMENTS

| | | | | |
|---|---|---|---|---|
| 4,277,283 A | | 7/1981 | Tobioka et al. | |
| 4,548,786 A | | 10/1985 | Yohe | |
| 4,610,931 A | | 9/1986 | Nemeth et al. | |
| 5,750,247 A | * | 5/1998 | Bryant et al. | 428/323 |
| 6,177,178 B1 | * | 1/2001 | Ostlund et al. | 428/216 |
| 6,333,100 B1 | * | 12/2001 | Palmqvist et al. | 428/216 |
| 6,468,680 B1 | * | 10/2002 | Waldenstrom et al. | 428/698 |

FOREIGN PATENT DOCUMENTS

| | | |
|---|---|---|
| EP | 0 263 747 A1 | 4/1988 |
| EP | 0 560 212 A1 | 9/1993 |
| EP | 0 569 696 A2 | 11/1993 |
| EP | 1 043 416 A2 | 10/2000 |

OTHER PUBLICATIONS

R. Frykholm et al., "Effect of cubic phase composition on gradient zone formation in cemented carbides", *International Journal of Refractory Metals & Hard Materials*, Elsevier Science Ltd., 19 (2001), pp. 527–538.

* cited by examiner

*Primary Examiner*—Ngoclan T. Mai
(74) *Attorney, Agent, or Firm*—Burns, Doane, Swecker & Mathis, L.L.P.

(57) ABSTRACT

A cutting tool insert has a cemented carbide substrate and a coating. The cemented carbide substrate includes 73–93 wt % WC, 4–12 wt % binder phase, and cubic carbide phase with a binder phase enriched surface zone essentially free of cubic carbide phase. The cubic carbide phase includes elements from the groups IVB and VB, with the Ta content on a level corresponding to a technical impurity. Inserts according to the invention exhibit favorable edge strength and thermal shock resistance.

17 Claims, 2 Drawing Sheets

CEMENTED CARBIDE WITH BINDER PHASE ENRICHED SURFACE ZONE

FIELD OF THE INVENTION

The present invention relates to coated cemented carbide articles with a binder phase enriched surface zone. More particularly, the present invention relates to coated inserts in which the cubic carbide phase has been optimised in such a way that edge strength and thermal shock resistance can be obtained without, or with only small amounts of, tantalum carbide additions.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

Coated cemented carbide inserts with binder phase enriched surface zone are used to a great extent for machining of steel and stainless materials. Through the use of a binder phase enriched surface zone an extension of the application area is obtained.

Methods of producing binder phase enriched surface zones on cemented carbides containing WC, cubic carbide phase and binder phase are known as gradient sintering and have been known for some time, e.g., through Tobioka (U.S. Pat. No. 4,277,283), Nemeth (U.S. Pat. No. 4,610,931) and Yohe (U.S. Pat. No. 4,548,786).

The patents by Tobioka, Nemeth and Yohe describe methods to accomplish binder phase enrichment by dissolution of the cubic carbide phase close to the insert surfaces. Their methods require that the cubic carbide phase contains some nitrogen, since dissolution of cubic carbide phase at the sintering temperature requires a partial pressure of nitrogen within the body being sintered exceeding the partial pressure of nitrogen within the sintering atmosphere. The nitrogen can be added through the powder and/or the furnace atmosphere during the sintering cycle. The dissolution of the cubic carbide phase results in small volumes that will be filled with binder phase, thus giving the desired binder phase enrichment. As a result, a surface zone generally about 25 μm thick consisting of essentially WC and binder phase is obtained. Although the cubic carbide phase is essentially a carbonitride phase, the material is herein referred to as a cemented carbide.

Cemented carbides with a binder phase enrichment formed by dissolution of the cubic carbide phase usually contain the cubic carbide forming elements tantalum, titanium and niobium. It has been disclosed in EP-A-1043416 that a positive effect on the machining properties can be obtained if the amount of niobium is kept below 0.1 wt %. Moreover, EP-A-0560212 and EP-A-0569696 disclose the use of hafnium and zirconium additions. The total as well as the relative amounts of these elements result in slightly different properties of the cemented carbide insert. Tantalum for example is known to inhibit grain growth of the tungsten carbide grains, and to be advantageous to the toughness behaviour of the insert. Niobium has been found to form a more pronounced binder phase depleted zone just beneath the binder enriched surface zone in gradient structured cemented carbides (Frykholm et al., Int. J. of Refractory Metals & Hard Materials, Volume 19 (2001) pages 527–538), which is likely to result in a more brittle behaviour. Tantalum gives a more even distribution of the binder phase in the zone enriched in cubic carbide phase.

SUMMARY OF THE INVENTION

Surprisingly, it has now been found that according to the present invention, inserts containing cubic carbides of the elements from the groups IVB and VB, except tantalum, show better performance in cutting tests than inserts that contain tantalum.

According to one aspect, there is provided a coated cutting tool insert comprising a cemented carbide substrate and a coating, said substrate comprising WC, a binder phase, a cubic carbide phase, and a binder phase enriched surface zone essentially free of the cubic carbide phase, the substrate comprises 73–93 wt % WC, 4–12 wt % cobalt, balance cubic carbides of the elements chosen from the groups IVB and VB containing more than 0.3 wt % Ti and more than 0.5 wt % Nb, with a Ta content less than 0.3 wt %.

BRIEF DESCRIPTION OF THE DRAWING FIGURES

DETAILED DESCRIPTION OF THE INVENTION

Figure 1:
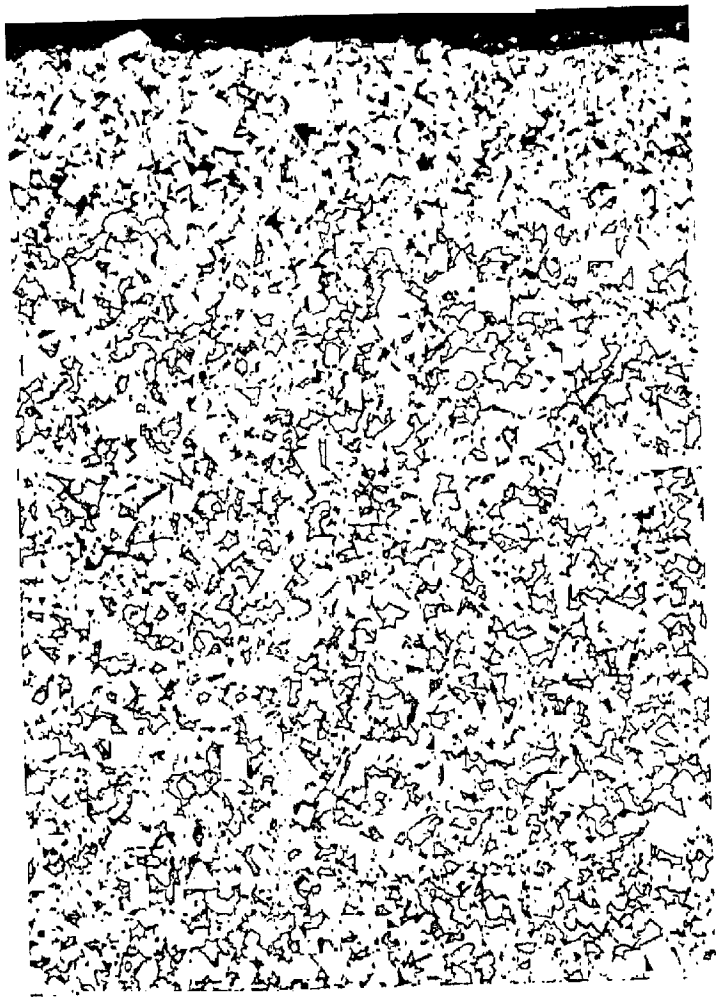
FIG. 1 shows in 1000× magnification the microstructure of a binder phase enriched surface zone of an insert according to the invention.
Figure 2:
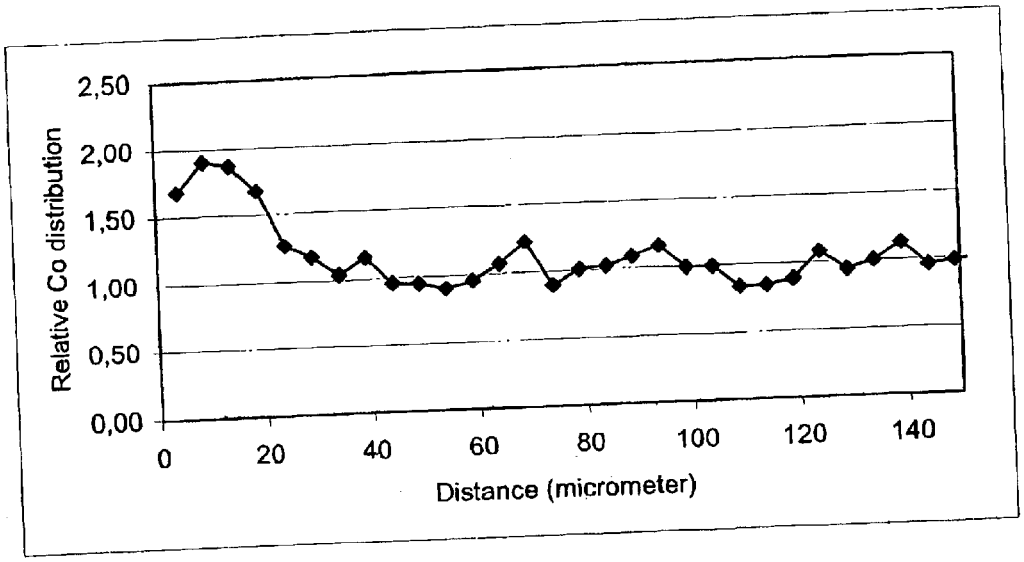
FIG. 2 shows the distribution of Co in the surface region of an insert according to the invention.

According to the present invention there is now provided a cemented carbide with a less than 75 μm, preferably 10–50 μm, thick binder phase enriched surface zone. This zone is essentially free of cubic carbide phase. Below this binder enriched surface zone there is a cubic carbide phase enrichment. The amount of the enrichment depends on the cubic carbide forming elements. The binder phase content of the binder phase enriched surface zone has a maximum in the inner part of 1.2–3 times the nominal binder phase content.

The present invention is applicable to cemented carbides with varying amounts of binder phase and cubic carbide phase. The binder phase preferably contains cobalt and dissolved carbide forming elements such as tungsten, titanium and niobium. However, there is no reason to believe that neither an intentional or unintentional addition of nickel or iron should influence the result appreciably, nor will small additions of metals that can form intermetallic phases with the binder phase or any other form of dispersions influence the result appreciably.

The coated cutting tool insert comprises a cemented carbide substrate and a coating, where the substrate comprises WC, binder phase and cubic carbide phase with a binder phase enriched surface zone essentially free of cubic carbide phase.

The substrate comprises 73–93 wt % WC, 4–12, preferably 5–9, wt %, more preferably 5–8 wt %, cobalt, balance cubic carbides of the elements from the groups IVB and VB containing more than 0.3 wt % Ti and more than 0.5 wt % Nb, with a tantalum content on a level corresponding to a technical impurity, that is less than 0.3 wt %, preferably less than 0.1 wt %.

The content of tungsten in the binder phase may be expressed as the S-value=$\sigma/16.1$, where $\sigma$ is the measured magnetic moment of the binder phase in $\mu Tm^3kg^{-1}$. The S-value depends on the content of tungsten in the binder phase and increases with a decreasing tungsten content. Thus, for pure cobalt, or a binder that is saturated with carbon, S=1 and for a binder phase that contains tungsten in an amount that corresponds to the borderline to formation of η-phase, S=0.78.

It has now been found according to the present invention that improved cutting performance is achieved if the cemented carbide body has an S-value within the range 0.86–0.96, preferably 0.89–0.93.

Furthermore, the mean intercept length of the tungsten carbide phase measured on a ground and polished representative cross section is in the range 0.5–0.9 μm. The mean intercept length of the cubic carbide phase is essentially the same as for tungsten carbide. The intercept length is measured by means of image analysis on micrographs with a magnification of 10000× and calculated as the average mean value of approximately 1000 intercept lengths.

In a first preferred embodiment, the amount of cubic carbide corresponds to 3–12 wt % of the cubic carbide forming elements titanium and niobium, preferably 4–8% wt %. The titanium content is 0.5 to 5 wt %, preferably to 1 and 4 wt %. The niobium content is 1 to 10 wt %, preferably 2 to 6 wt %.

In a second embodiment up to 60 wt % of niobium is replaced by zirconium, preferably 25–50 wt %.

In a third embodiment the amount of cubic carbide corresponds to 4–15 wt % of the cubic carbide forming elements titanium, niobium and hafnium, preferably 6–10 wt %. The titanium content is 0.5 to 5 wt %, preferably 1 to 4 wt %. The niobium content is 0.5 to 6 wt %, preferably 1 to 4 wt %. The hafnium content is 1 to 9 wt %, preferably 1 to 6 wt %.

The amount of nitrogen, added either through the powder or through the sintering process or a combination thereof, determines the rate of dissolution of the cubic carbide phase during sintering. The optimum amount of nitrogen depends on the amount and type of cubic carbide phase and can vary from 0.1 to 8 wt %, as a percentage of the weight of titanium, niobium, zirconium and hafnium.

Production of cemented carbides according to the invention is done in either of two ways or a combination thereof: (i) by sintering a presintered or compacted body containing a nitride or a carbonitride in an inert atmosphere or in vacuum as disclosed in U.S. Pat. No. 4,610,931, or (ii) by nitriding the compacted body as disclosed in U.S. Pat. No. 4,548,786 followed by sintering in an inert atmosphere or in vacuum.

Cemented carbide inserts according to the invention are preferably coated with thin wear resistant coatings by CVD-, MTCVD- or PVD-techniques or a combination of CVD and MTCVD. Preferably there is deposited an innermost coating of carbide, nitride and/or carbonitride preferably of titanium. Subsequent layers can be formed of carbides, nitrides and/or carbonitrides preferably of titanium, zirconium and/or hafnium, and/or oxides of aluminium and/or zirconium.

EXAMPLE 1

Turning inserts CNMG120408 and milling inserts SEKN1203AFTN were made by conventional milling of a powder mixture consisting of (Ti,W)C, Ti(C,N), NbC, WC and Co with a composition of 2.0 wt % Ti, 3.8 wt % Nb, 5.9 wt % Co, 6.20 wt % C, balance W, pressing and sintering. The inserts were sintered in $H_2$ up to 400° C. for dewaxing and further in vacuum to 1260° C. From 1260° C. to 1350° C. the inserts were nitrided in an atmosphere of $N_2$ and after that in a protective atmosphere of Ar for 1 h at 1460° C.

The surface zone of the inserts consisted of a 20 μm thick binder phase enriched part essentially free of cubic carbide phase. The maximum cobalt content in this part was about 12 wt %. The S-value of the inserts was 0.90 and the mean intercept length of the tungsten carbide phase 0.7 μm. The CNMG120408 inserts were coated according to known CVD-technique with a coating consisting of 6 μm Ti(C,N), 8 μm $Al_2O_3$ and 3 μm TiN. The SEKN1203AFTN inserts were coated according to known CVD-technique with a coating consisting of 4 μm Ti(C,N) and 3 μm $Al_2O_3$.

EXAMPLE 2

Example 1 was repeated but with the 3.8 wt % Nb replaced by 2.0 wt % Nb and 3.2 wt % Hf. The powder contained 6.10 wt % C.

The surface zone of the inserts consisted of a 20 μm thick binder phase enriched part essentially free of cubic carbide phase. The maximum cobalt content in this part was about 12 wt %. The S-value was 0.91 and the mean intercept length of the tungsten carbide phase 0.7 μm. The inserts were coated according to Example 1.

EXAMPLE 3

Comparative Example

Example 1 was repeated but with the 3.8 wt % Nb replaced by 2.0 wt % Nb and 3.4 wt % Ta. The powder contained 6.09 wt % C.

The surface zone of the inserts consisted of a 20 μm thick binder phase enriched part essentially free of cubic carbide phase. The maximum cobalt content in this part was about 12 wt %. The S-value of the inserts was 0.90 and the mean intercept length of the tungsten carbide phase 0.7 μm. The inserts were coated according to Example 1.

EXAMPLE 4

Turning inserts CNMG120408 and milling inserts SEKN1203AFTN were made by conventional milling of a powder mixture consisting of (Ti,W)C, Ti(C,N), NbC, ZrC, WC and Co with a composition of 2.0 wt % Ti, 2.1 wt % Nb, 1.6 wt % Zr, 6.3 wt % Co, 6.15 wt % C, balance W, pressing and sintering. The inserts were sintered in $H_2$ up to 400° C. for dewaxing and further in vacuum to 1260° C. From 1260° C. to 1350° C. the inserts were nitrided in an atmosphere of $N_2$ and after that in a protective atmosphere of Ar for 1h at 1460° C.

The surface zone of the inserts consisted of a 20 μm thick binder phase enriched part essentially free of cubic carbide phase. The maximum cobalt content in this part was about 12 wt %. The S-value of the inserts was 0.86 and the mean intercept length of the cubic carbide phase 0.85 μm. The CNMG120408 inserts were coated according to known CVD-technique with a coating consisting of 8 μm Ti(C,N), 2 μm $Al_2O_3$ and 1 μm TiN. The SEKN1203AFTN inserts were coated according to known CVD-technique with a coating consisting of 4 μm Ti(C,N) and 3 μm $Al_2O_3$.

EXAMPLE 5

Comparative Example

Example 4 was repeated but with the Zr replaced by 3.4 wt % Ta. The powder contained 6.07 wt % C.

The surface zone of the inserts consisted of a 20 μm thick binder phase enriched part essentially free of cubic carbide phase. The maximum cobalt content in this part was about 12 wt %. The S-value was 0.87 and the mean intercept length of the cubic carbide phase 0.8 μm. The inserts were coated according to Example 4.

EXAMPLE 6

With the CNMG120408 inserts of examples 1, 2, 3, 4 and 5 a test consisting of an intermittent turning operation in a steel workpiece of SS1672 was performed with the following cutting data:

Speed: 140 m/min (Example 1, 2 and 3)

Speed: 80 m/min (Example 4 and 5)

Feed: 0.1–0.8 mm/rev

Cutting depth: 2 mm 10 edges of each variant were tested with increasing feed up to 0.8 mm/rev. The number of undamaged edges for each feed is shown in the table below.

| Feed (mm/rev) | Example 1 (invention) | Example 2 (invention) | Example 3 (comparative) | Example 4 (invention) | Example 5 (comparative) |
|---|---|---|---|---|---|
| 0.10 | 10 | 10 | 10 | 10 | 10 |
| 0.14 | 10 | 10 | 9 | 10 | 9 |
| 0.16 | 10 | 10 | 8 | 9 | 9 |
| 0.20 | 9 | 9 | 6 | 8 | 7 |
| 0.25 | 8 | 7 | 3 | 6 | 5 |
| 0.32 | 8 | 7 | 3 | 6 | 4 |
| 0.40 | 7 | 7 | 3 | 6 | 4 |
| 0.50 | 7 | 6 | 3 | 6 | 3 |
| 0.63 | 3 | 2 | 0 | 4 | 1 |
| 0.80 | 1 | 0 | 0 | 1 | 0 |

EXAMPLE 7

The SEKN1203AFTN inserts from examples 1, 2, 3, 4 and 5 were tested in a face milling operation with coolant in a steel workpiece of SS2541. The following cutting data were used:

Cutter diameter: 125 mm

Speed: 250 m/min

Feed per tooth: 0.2 mm

Depth of cut: 2.5 mm

Width of cut: 26 mm

Length of cut: 600, 1200, 1500 and 1800 mm

The operation lead to comb cracking of the cutting edge of the insert. The maximum comb crack length (mm) on the flank face was measured for five edges of each of the Examples 1–5, with the following results:

| Length of cut (mm) | Example 1 (invention) | Example 2 (invention) | Example 3 (comparative) | Example 4 (invention) | Example 5 (comparative) |
|---|---|---|---|---|---|
| 600 | 0.10 | 0.11 | 0.15 | 0.12 | 0.18 |
| 1200 | 0.18 | 0.23 | 0.28 | 0.22 | 0.26 |
| 1500 | 0.18 | 0.21 | 0.28 | 0.23 | edge failure |
| 1800 | 0.22 | 0.23 | edge failure | 0.25 | edge failure |

From Examples 6 and 7 it is apparent that inserts according to the invention, Examples 1, 2 and 4, exhibit a better edge toughness than inserts according to the comparative examples. In addition, inserts according to the invention in Examples 1, 2 and 4 show better resistance to mechanical impact and thermal shock than inserts according to the comparative examples. In particular, inserts according to Example 1 exhibit the most favourable properties of the three Examples (1, 2 and 4) according to the invention. It is evident that the invention leads to improved edge strength as well as improved mechanical impact and thermal shock properties of the cutting tool.

While the present invention has been described by reference to the above-mentioned embodiments, certain modifications and variations will be evident to those of ordinary skill in the art. Therefore, the present invention is limited only by the scope and spirit of the appended claims.

We claim:

1. A coated cutting tool insert comprising a cemented carbide substrate and a coating, said substrate comprising WC, a binder phase, a cubic carbide phase, and a binder phase enriched surface zone essentially free of the cubic carbide phase, the substrate comprises 73–93 wt % WC, 4–12 wt % cobalt, balance cubic carbides of the elements chosen from the groups IVB and VB containing more than 0.3 wt-% Ti and more than 0.5 wt-% Nb, with a Ta content less than 0.3% by weight.

2. The coated cutting tool insert according to claim 1, wherein the Ta content is less than 0.1 wt %.

3. The coated cutting tool insert according to claim 1, wherein the substrate comprises a total of 3–12 wt % of cubic carbide forming elements Ti and Nb.

4. The coated cutting tool insert according to claim 3, wherein the substrate comprises a total of 4–8 wt % of cubic carbide forming elements Ti and Nb.

5. The coated cutting tool insert according to the claim 3, wherein the Ti content of the substrate is 0.5–5 wt % and the Nb content is 1–10 wt %.

6. The coated cutting tool insert according to claim 5, wherein the Ti content is 1–4 wt % and the Nb content is 2–6 wt %.

7. The coated cutting tool insert according to claim 5, wherein up to 60% of the Nb content of the substrate is replaced by Zr.

8. The coated cutting tool insert according to claim 7, wherein up to 25–50% of the Nb content of the substrate is replaced by Zr.

9. The coated cutting tool insert according to claim 1, wherein the substrate comprises 4–15 wt % of the cubic carbide forming elements Ti, Nb and Hf.

10. The coated cutting tool insert according to claim 9, wherein the substrate comprises 6–10 wt % of the cubic carbide forming elements Ti, Nb and Hf.

11. The coated cutting tool insert according to claim 9, wherein the Ti content of the substrate is 0.5–4 wt %, the Nb content is 0.5–6 wt %, and the Hf content is 1–9 wt %.

12. The coated cutting tool insert according to claim 11, wherein the Nb content is 1–4 wt %, and the Hf content is 1–6 wt %.

13. The coated cutting tool insert according to claim 1, wherein the substrate has an S-value of 0.86–0.96.

14. The coated cutting tool insert according to claim 13, wherein the substrate has an S-value of 0.89–0.93.

15. The coated cutting tool insert according to claim 1, having a mean intercept length in the WC phase of the substrate of 0.5–0.9 $\mu$m.

16. The coated cutting tool according to claim 1, wherein the depth of the binder phase enriched surface zone is less than 75 $\mu$m and the binder phase content of the binder phase enriched surface zone has a maximum of 1.2–3 times the nominal binder phase content.

17. The coated cutting tool insert according to claim 16, wherein the depth of the binder phase enriched surface zone is approximately 10–50 $\mu$m.

* * * * *

UNITED STATES PATENT AND TRADEMARK OFFICE

CERTIFICATE OF CORRECTION

PATENT NO. : 6,761,750 B2
DATED : July 13, 2004
INVENTOR(S) : Jenni Zackrisson et al.

It is certified that error appears in the above-identified patent and that said Letters Patent is hereby corrected as shown below:

Title page,
Insert Item -- [30] Foreign Application Priority Data
November 27, 2001 (SE)……...0103970-0 --.

Signed and Sealed this

Fourteenth Day of December, 2004

JON W. DUDAS
*Director of the United States Patent and Trademark Office*